US006000955A

United States Patent [19]

Zaderej

[11] Patent Number: 6,000,955

[45] Date of Patent: Dec. 14, 1999

[54] MULTIPLE TERMINAL EDGE CONNECTOR

[75] Inventor: Victor Zaderej, St. Charles, Ill.

[73] Assignee: Gabriel Technologies, Inc., Elgin, Ill.

[21] Appl. No.: 09/208,030

[22] Filed: Dec. 9, 1998

Related U.S. Application Data

[60] Provisional application No. 60/067,774, Dec. 10, 1997.

[51] Int. Cl.[6] ..... H01R 9/09

[52] U.S. Cl. ..... 439/79; 439/79; 439/541

[58] Field of Search ..... 439/79, 541.5, 439/61, 62, 65, 886

[56] References Cited

U.S. PATENT DOCUMENTS

| | | | |
|---|---|---|---|
| 3,148,929 | 9/1964 | Gordon . | |
| 3,395,377 | 7/1968 | Straus . | |
| 3,692,966 | 9/1972 | Lancaster . | |
| 3,760,335 | 9/1973 | Roberts . | |
| 3,853,382 | 12/1974 | Lazar | 339/95 |
| 3,963,300 | 6/1976 | Patton et al. . | |
| 3,993,936 | 11/1976 | Meade et al. | 317/101 |
| 4,179,178 | 12/1979 | Bachman et al. . | |
| 4,392,705 | 7/1983 | Andrews, Jr. et al. . | |
| 4,397,086 | 8/1983 | Bickos et al. | 29/876 |
| 4,418,972 | 12/1983 | Benasutti . | |
| 4,456,800 | 6/1984 | Holland . | |
| 4,458,291 | 7/1984 | Yanagisawa et al. . | |
| 4,477,134 | 10/1984 | Wright . | |
| 4,531,176 | 7/1985 | Beecher, II . | |
| 4,532,419 | 7/1985 | Takeda . | |
| 4,568,133 | 2/1986 | Amano et al. . | |
| 4,597,631 | 7/1986 | Flores . | |
| 4,673,236 | 6/1987 | Musolff et al. . | |
| 4,688,868 | 8/1987 | Noyes . | |
| 4,692,121 | 9/1987 | Arbogast, Jr. . | |
| 4,697,864 | 10/1987 | Hayes et al. . | |
| 4,699,438 | 10/1987 | Kikuta . | |
| 4,705,339 | 11/1987 | Hayes et al. . | |
| 4,711,506 | 12/1987 | Tanaka . | |
| 4,731,031 | 3/1988 | Lemke . | |
| 4,737,116 | 4/1988 | Slye et al. . | |
| 4,743,080 | 5/1988 | Siraty . | |
| 4,767,350 | 8/1988 | Cooper et al. . | |
| 4,773,878 | 9/1988 | Hansell, III . | |
| 4,806,109 | 2/1989 | Manabe et al. . | |
| 4,824,377 | 4/1989 | De Burro . | |
| 4,824,383 | 4/1989 | Lemke . | |
| 4,846,727 | 7/1989 | Glover et al. . | |
| 4,889,497 | 12/1989 | Riches . | |
| 4,889,502 | 12/1989 | Althouse et al. . | |
| 4,906,208 | 3/1990 | Nakamura et al. . | |
| 4,936,785 | 6/1990 | Krug et al. | 439/75 |
| 4,991,666 | 2/1991 | Septfons et al. | 174/261 |
| 5,030,140 | 7/1991 | Sugiyama . | |
| 5,064,391 | 11/1991 | Buchter . | |

(List continued on next page.)

FOREIGN PATENT DOCUMENTS

| | | |
|---|---|---|
| 49-6543 | 2/1974 | Japan . |

*Primary Examiner*—Paula Bradley
*Assistant Examiner*—Truc Nguyen
*Attorney, Agent, or Firm*—Trexler, Bushnell, Giangiorgi & Blackstone, Ltd.

[57] ABSTRACT

A connector is formed from male connector and female connector which are joined together. The male connector includes a housing, a pair of plastic contact boards mounted therein, a plurality of lengths of electrically conductive plating provided each side of each contact board, and a plurality of straight, electrically conductive contact pins attached to the contact boards. The contact pins are in electrical connection with respective lengths of plating on the contact boards. The female connector includes a housing, two pairs of plastic contact boards mounted therein, a plurality of lengths of electrically conductive plating provided on one side of each contact board, and a plurality of straight, electrically conductive contact pins attached to the respective contact boards. The contact pins are in electrical connection with respective lengths of plating on the contact boards. The male and female connectors are connected together by metal shrouds provided on each connector.

45 Claims, 17 Drawing Sheets

U.S. PATENT DOCUMENTS 5,066,240 11/1991 Verdun .
5,080,611 1/1992 Hypes .
5,085,601 2/1992 Buchter et al. .
5,102,353 4/1992 Brunker et al. .
5,104,329 4/1992 Brown et al. .
5,104,341 4/1992 Gilissen et al. .
5,114,355 5/1992 Kimmel et al. .
5,114,362 5/1992 Olsson .
5,116,230 5/1992 Dechelette et al. .
5,127,839 7/1992 Korsunsky et al. .
5,127,843 7/1992 Henry et al. .
5,127,852 7/1992 Cravens et al. .
5,139,446 8/1992 Costello et al. .
5,147,226 9/1992 Kile .
5,154,618 10/1992 Nikoloff et al. .
5,158,474 10/1992 Frantz .
5,160,273 11/1992 Carney .
5,163,851 11/1992 Hart et al. .
5,169,324 12/1992 Lemke et al. .
5,183,405 2/1993 Elicker et al. .
5,194,010 3/1993 Dambach et al. ..... 439/79
5,194,022 3/1993 Enomoto .
5,199,886 4/1993 Patterson .
5,205,977 4/1993 Green et al. .
5,219,294 6/1993 Marsh et al. .
5,228,861 7/1993 Grabbe .
5,228,870 7/1993 Gorenc et al. .
5,238,413 8/1993 McCaffrey et al. .
5,252,079 10/1993 Grabbe .
5,266,047 11/1993 Black et al. .
5,267,126 11/1993 Henschen et al. .
5,267,875 12/1993 Koegel et al. .
5,269,703 12/1993 Ikegami .
5,288,247 2/1994 Kaufman .
5,292,263 3/1994 Mosser et al. .
5,318,452 6/1994 Brennian, Jr. et al. .
5,334,048 8/1994 Bowers et al. .
5,336,111 8/1994 Thrush et al. .
5,338,207 8/1994 Lienberry et al. .
5,340,336 8/1994 Menechella .
5,356,300 10/1994 Costello et al. .
5,357,074 10/1994 Pawlikowski .
5,357,404 10/1994 Bright et al. .
5,358,413 10/1994 Daly et al. .
5,362,257 11/1994 Neal et al. .
5,368,491 11/1994 Locati .
5,372,520 12/1994 Kilbey et al. .
5,380,210 1/1995 Grabbe et al. .
5,380,223 1/1995 Marsh et al. .
5,382,168 1/1995 Azuma et al. ..... 439/65
5,393,234 2/1995 Yamada et al. .
5,399,106 3/1995 Ferry .
5,409,400 4/1995 Davis .
5,411,416 5/1995 Balon et al. .
5,415,568 5/1995 Kinoshita .
5,431,584 7/1995 Ferry .
5,466,162 11/1995 Schroepfer et al. .
5,468,162 11/1995 Oda .
5,472,354 12/1995 Chen et al. ..... 439/357
5,474,472 12/1995 Niwa et al. .
5,486,121 1/1996 Miller .
5,487,682 1/1996 Miller et al. .
5,489,219 2/1996 Fabian .
5,496,195 3/1996 Reed .
5,498,166 3/1996 Rothenberger .
5,498,174 3/1996 Speer et al. .
5,501,606 3/1996 Oda et al. .
5,518,425 5/1996 Davis .
5,533,901 7/1996 Hunt et al. .
5,536,179 7/1996 Olsson et al. .
5,545,051 8/1996 Summers et al. .
5,551,883 9/1996 Davis .
5,551,891 9/1996 Huss, Jr. .
5,558,526 9/1996 Nagamine .
5,567,168 10/1996 Marsh et al. .
5,582,519 12/1996 Buchter .
5,584,727 12/1996 Miller et al. .
5,586,911 12/1996 Miller et al. .
5,586,914 12/1996 Foster, Jr. et al. .
5,588,846 12/1996 Irbeck et al. .
5,588,877 12/1996 Davis et al. .
5,588,878 12/1996 Flinchbaugh et al. .
5,591,047 1/1997 Yamada et al. .
5,609,491 3/1997 Cooper et al. .
5,616,035 4/1997 Shu ..... 439/79
5,626,500 5/1997 Yoshimura .
5,639,249 6/1997 Lenoir ..... 439/79
5,643,013 7/1997 Weidler et al. .
5,645,435 7/1997 Cimino et al. .

58
66
36
32
50
56
38
40
34
68
62
60
52
62
44
42
64
36
50
48
38
66
56
40
68

MULTIPLE TERMINAL EDGE CONNECTOR

This application is based upon and claims the priority of provisional application Ser. No. 60/067,744, filed on Dec. 10, 1997, and entitled "Multiple Terminal Edge Connector".

BACKGROUND OF THE INVENTION

This invention is generally directed to a novel shielded electrical connector which is formed from a female connector and a male connector which are mated together. Such shielded electrical connectors are commonly used in computers and other types of electronic office equipment for the connection of signal carrying lines.

Prior art shielded electrical connectors, such as that disclosed in U.S. Pat. No. 5,533,901, employ a plurality of wires which are bent to form the electrical contacts in the connector. The bending of the wires causes several problems; the most prominent being that when the male and female connectors are joined together, the contacts be moved out of their correct position causing misalignment and failure to mate. In addition, because the wires must be bent to form the contacts, a thinner wire is used. This can cause problems as well.

The present invention overcomes the problems found in the prior art and presents several improvements to the prior art which will be understood upon a reading of the attached specification, in combination with a study of the drawings.

OBJECTS AND SUMMARY OF THE INVENTION

A general object of the present invention is to provide a novel shielded electrical connector which is formed from a female connector and a male connector which are mated together.

An object of the present invention is to provide a novel female connector which includes novel contact boards to which straight contact pins are soldered to eliminate the bending of the wires which presents a common problem in prior art connectors of this type.

Another object of the present invention is to provide a novel male connector which includes novel contact boards to which straight contact pins are soldered to eliminate the bending of the wires which presents a common problem in prior art connectors of this type.

Briefly, and in accordance with the foregoing, the present invention discloses a novel connector. The connector is formed from male connector and female connector which are joined together. The male connector includes a housing, a pair of plastic contact boards mounted therein, a plurality of lengths of electrically conductive plating provided each side of each contact board, and a plurality of straight, electrically conductive contact pins attached to the contact boards. The contact pins are in electrical connection with respective lengths of plating on the contact boards. The female connector includes a housing, two pairs of plastic contact boards mounted therein, a plurality of lengths of electrically conductive plating provided on one side of each contact board, and a plurality of straight, electrically conductive contact pins attached to the respective contact boards. The contact pins are in electrical connection with respective lengths of plating on the contact boards. The male and female connectors are connected together by metal shrouds provided on each connector. aid at least one contact pin is straight. The lengths of plating are preferably formed by a first layer of 0.001 of an inch of copper, a second layer of 0.0001 of an inch of nickel, and a third layer of 0.00003 of an inch of gold minimum. Each contact pin is preferably formed from gold plated or tin lead plated phosphor bronze and is preferably fifteen thousandths round.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
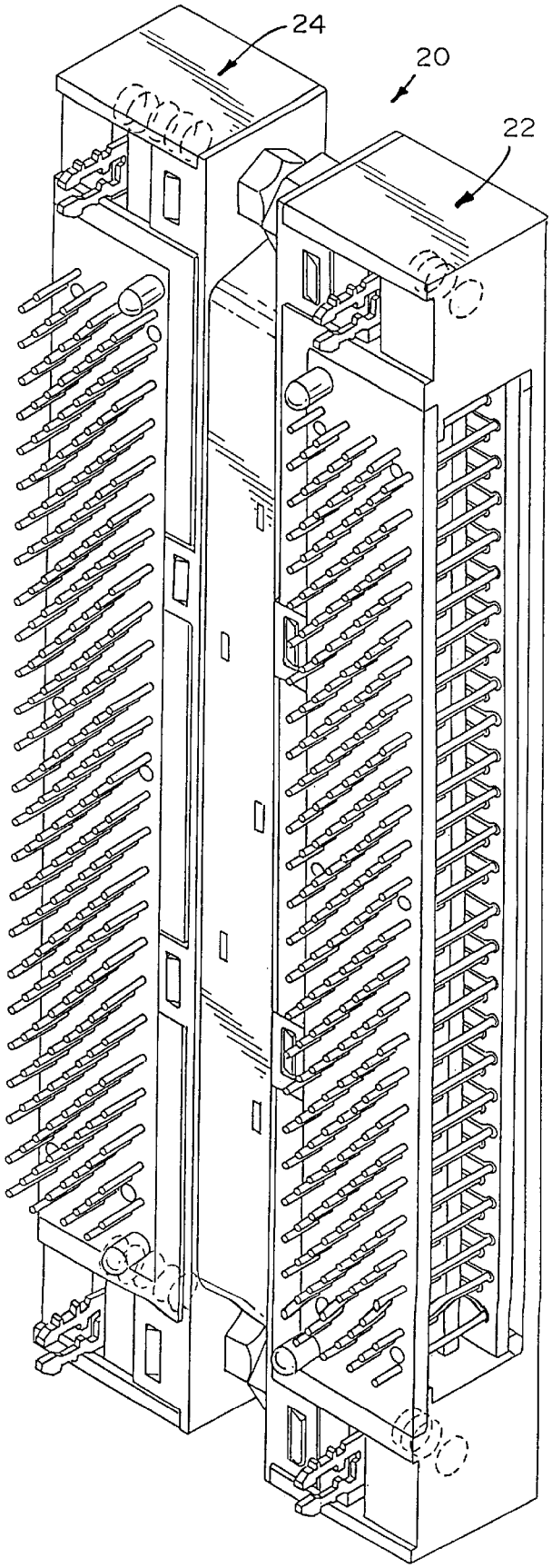
FIG. 1 is a perspective view of a connector which incorporates the features of the invention.
Figure 2:
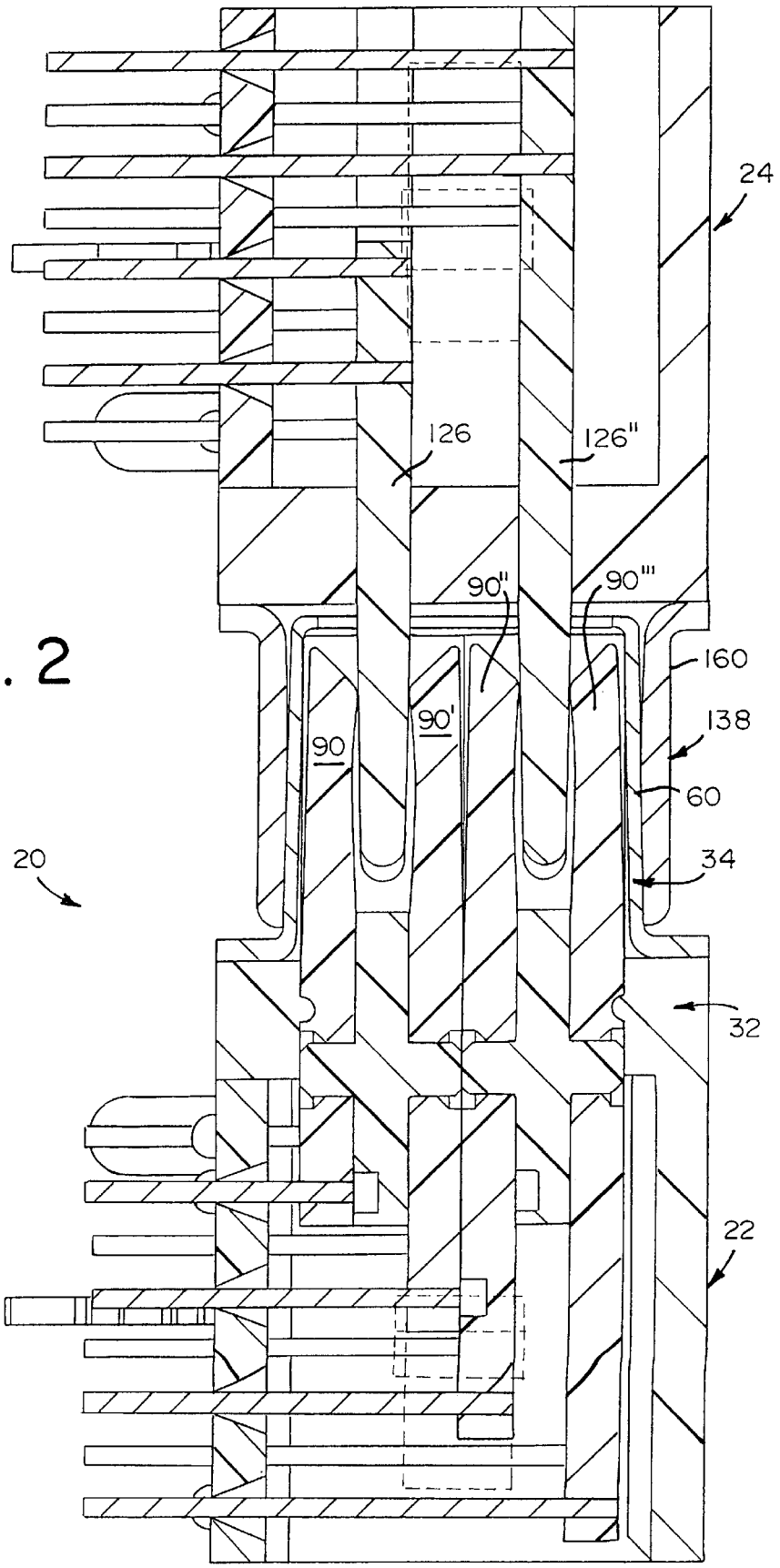
FIG. 2 is a cross-sectional view of the connector of FIG. 1.
Figure 3:
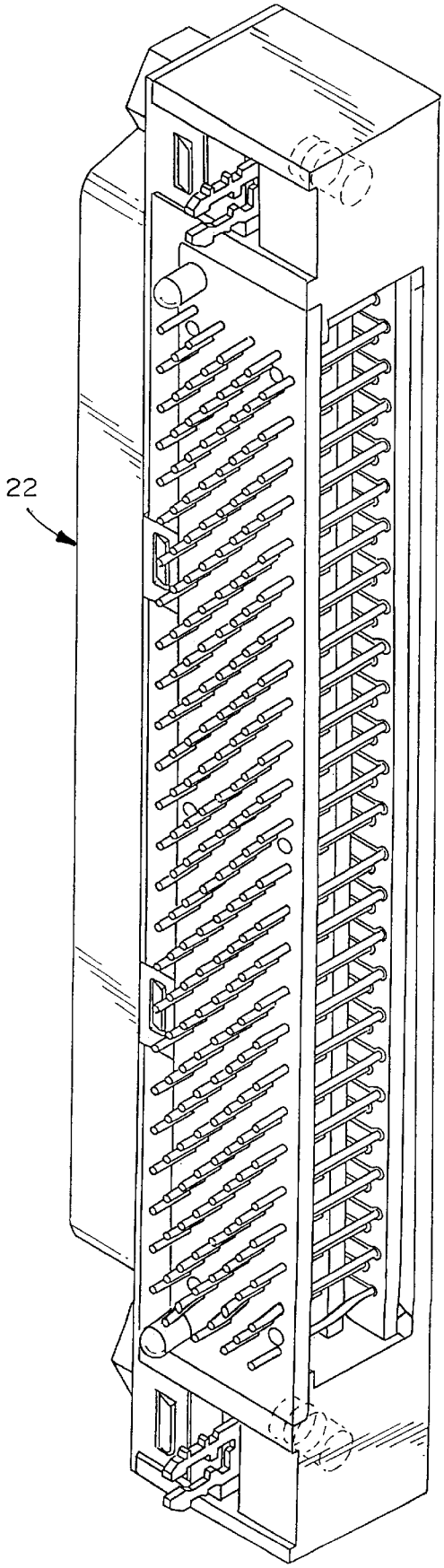
FIG. 3 is a perspective view of a female connector which forms a portion of the connector shown in FIG. 1 and which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 12:
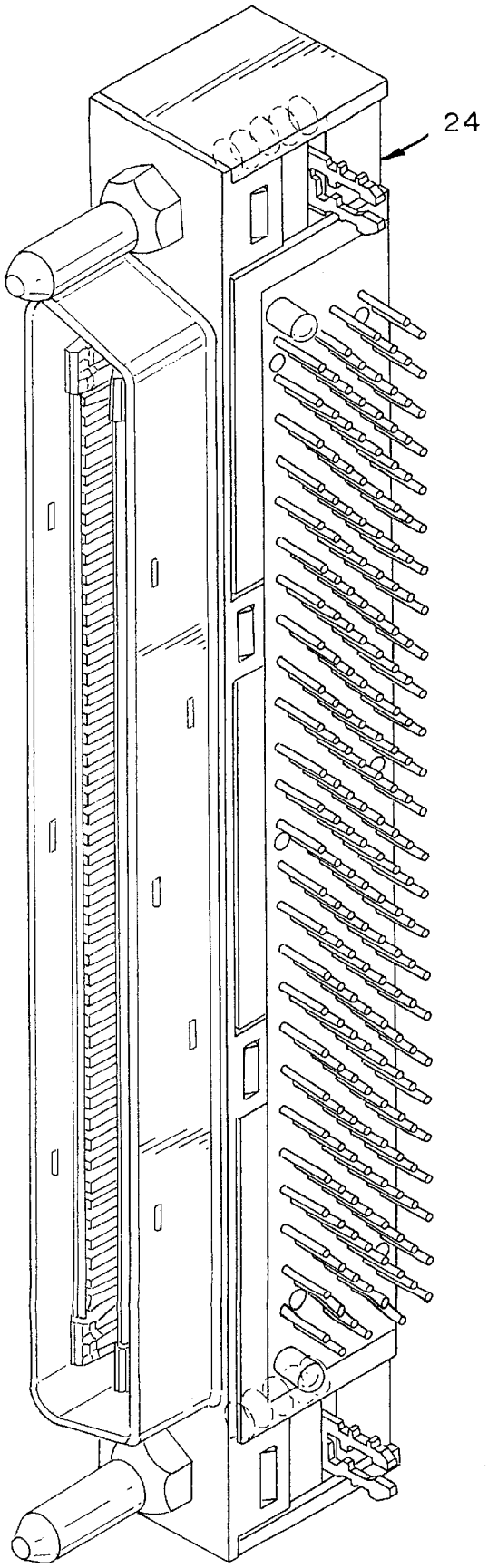
FIG. 12 is a perspective view of a male connector which forms a portion of the connector shown in FIG. 1 and which incorporates the features of the invention.

As shown in FIG. 1, the present invention provides a shielded electrical connector 20 which is formed from a female connector 22 and a male connector 24 which are mated together. The female connector 22 is shown in its final assembled form in FIGS. 1 and 3. The components of the female connector 22 and its method of assembly are shown in FIGS. 2–11. The male connector 24 is shown in its final assembled form in FIGS. 1 and 12. The components of the male connector 24 and its method of assembly are shown in FIGS. 2 and 13–17.

As described herein, each of the female connector 22 and the male connector 24 is provided with novel contact boards to which contact pins are soldered. The novel contact boards eliminate the bending of the wires which presents a common problem in prior art connectors of this type.

Figures 4A, 4B:
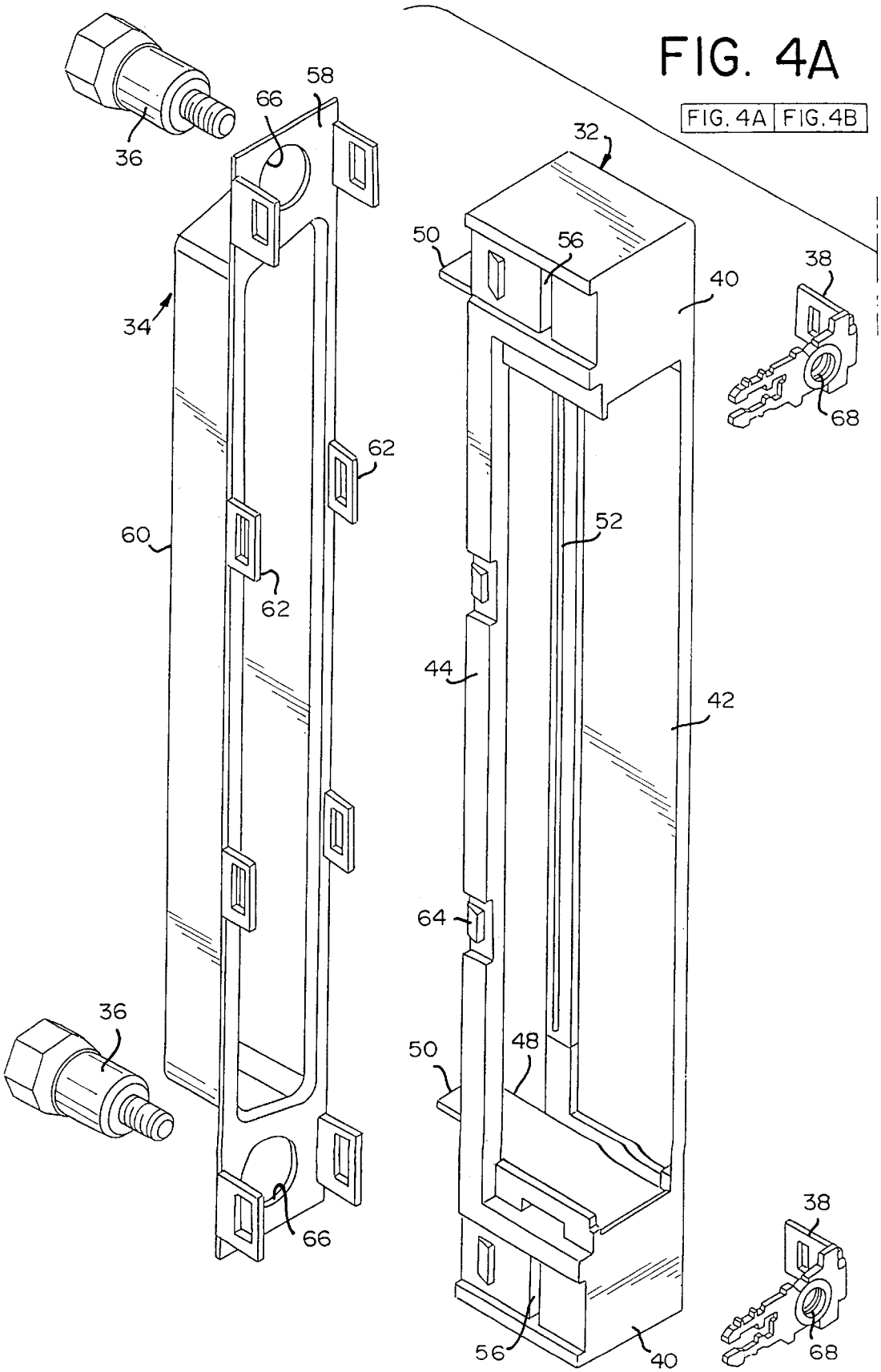
FIG. 4 is an exploded perspective view of the female connector.
Figure 4B:
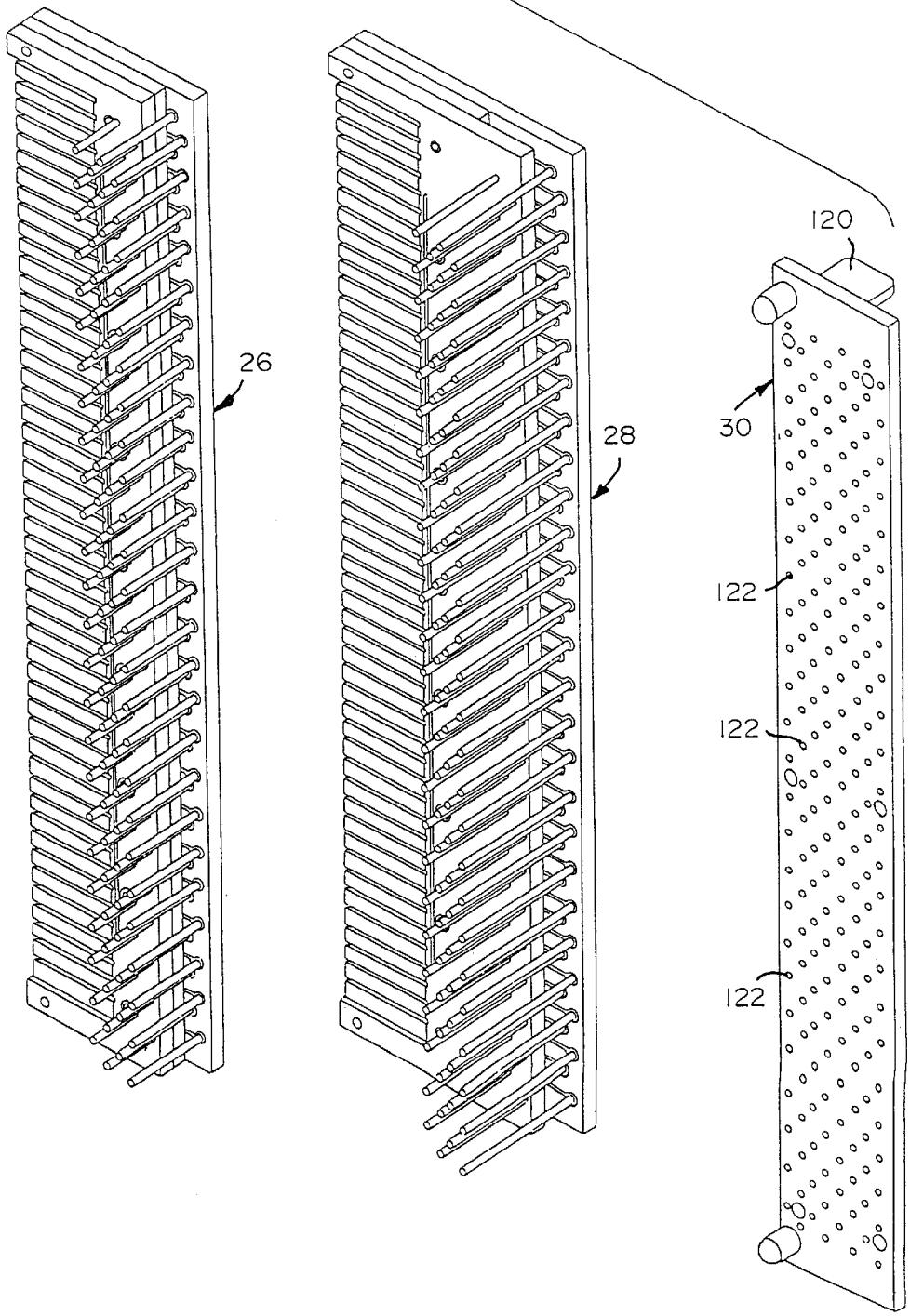

Attention is directed to FIGS. 3–11 which shows the specifics of the female connector 22. As shown in FIG. 4, the female connector 22 includes first and second contact board subassemblies 26, 28, a pin retainer plate 30, a housing 32, a metal shroud 34 which mounts on the housing 32 by a pair of metal guide posts 36 and a pair of metal board locks 38.

The housing 32 is formed from plastic, preferably liquid crystal polymer, and includes a pair of spaced apart end portions 40 which define opposite end walls, a rear wall 42 which extends between edges of the end portions 40, and a front wall 44 which extends between the opposite edges of the end portions 40. The upper surfaces of the end portions 40 and the front and rear walls 42, 44 define a top wall 46 of the housing 32. An elongated slot 48 is formed within the top wall 46. A pair of support members 50 extend from opposite ends of the elongated slot 48. The rear wall 42 extends along the entire height of the end portions 40 while the front wall 44 only extends along a portion of the height of the end portions 40. Each of the rear and front walls 42, 44 has an elongated, raised protrusion 52, 54, respectively, on the surface which forms the elongated slot 48.

Each end portion 40 of the housing 32 has a recess (not shown) formed therein which extends from the top surface thereof. An elongated slot 56 is also provided through each end portion 40 from its front surface to its rear surface, such elongated slot 40 extending transversely to the axis of the respective recesses.

The metal board locks 38 are preferably formed from soldered plated brass and are mounted within the respective elongated slots 56 for grounding to the base board (not shown in the drawings), thus reducing penetration of outside signal noise. The board locks 38 are conventional in design and function.

The metal shroud 34 is preferably nickel plated steel and is formed from a flat base portion 58 and a generally D-shaped mating portion 60 which extends upwardly from the base portion 58. A plurality of apertured tabs 62 extend downwardly from the base portion 58 for mating with corresponding protrusions 64 on the rear and front walls 42, 44 of the plastic housing 32 to mount the shroud 34 thereon. A pair of circular apertures 66 are provided through end portions of the base portion 58 and align with the recesses within the end portions of the housing 32 when the shroud 34 is mounted thereon.

The metal guide posts 36 are conventional and extend through the circular apertures 66 in the base portion 58 and seat within the recesses in the housing 32. A threaded portion of each guide post 36 threadedly mates with a threaded aperture 68 provided through the respective board locks 38 to secure the shroud 34 to the housing 32.

Attention is now directed to the structure of the first and second contact board subassemblies 26, 28. The first contact board subassembly 26 is formed from first and second contact boards 70, 70', each of which has a plurality of contact pins 74, 74', respectively, soldered thereto, and a spacer board 78 therebetween, as described herein. The second contact board subassembly 28 is formed from third and fourth contact boards 70", 70'", each of which has a plurality of contact pins 74", 74'", respectively, soldered thereto, and a spacer board 78' therebetween, as described herein.

Each contact board 70, 70', 70", 70'" is formed from a non-electrically conductive material, such as plastic, and is preferably formed from polyetherimide, sold under the trademark ULTEM® (a registered trademark of General Electric). The general structure of the contact boards 70, 70', 70", 70'" is described with respect to contact board 70 shown in FIGS. 6–8. The contact board 70 is formed from a generally flat member having a first side 90 and a second side 92 and which has a base portion 94 and a plurality of spaced-apart fingers 96 extending therefrom. A projection 98 is provided at the end of each finger 96 which is distal to the base portion 94. Opposite end portions 100 extend upwardly from the base portion 94 beyond the ends of the outermost fingers 96 and do not have a projection provided thereon. An aperture 101 is provided in each upper end of the respective end portions 100.

Figure 6:
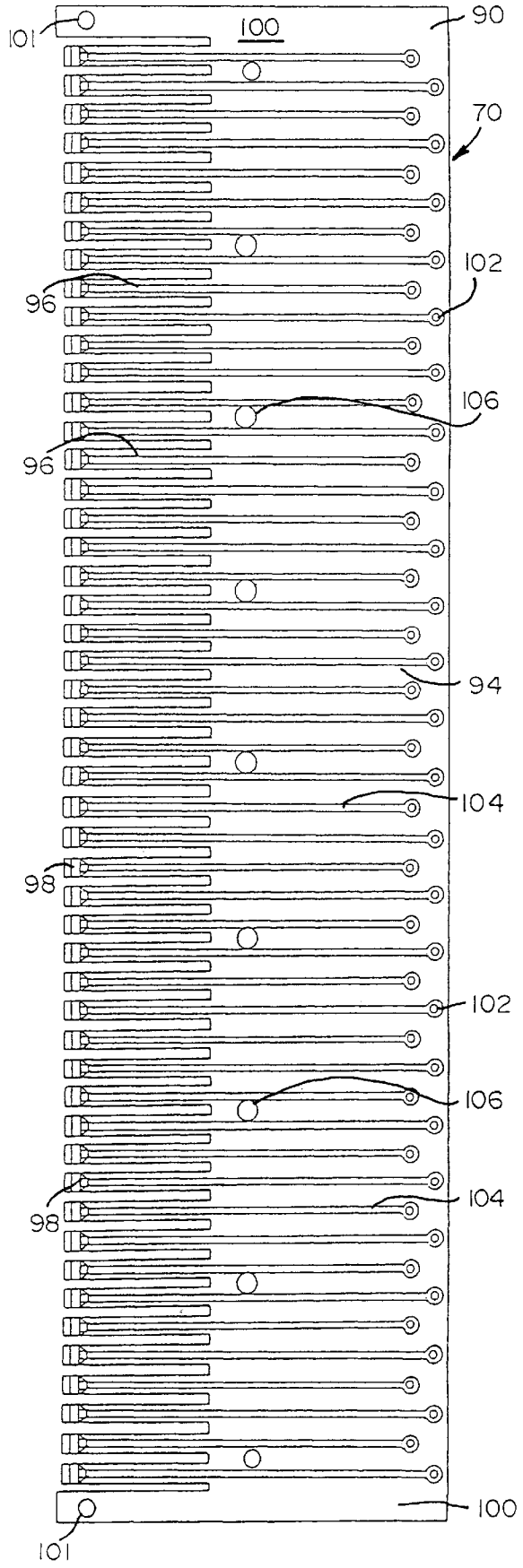
FIG. 6 is a front elevational view of a contact board used in the female connector.
Figure 7:
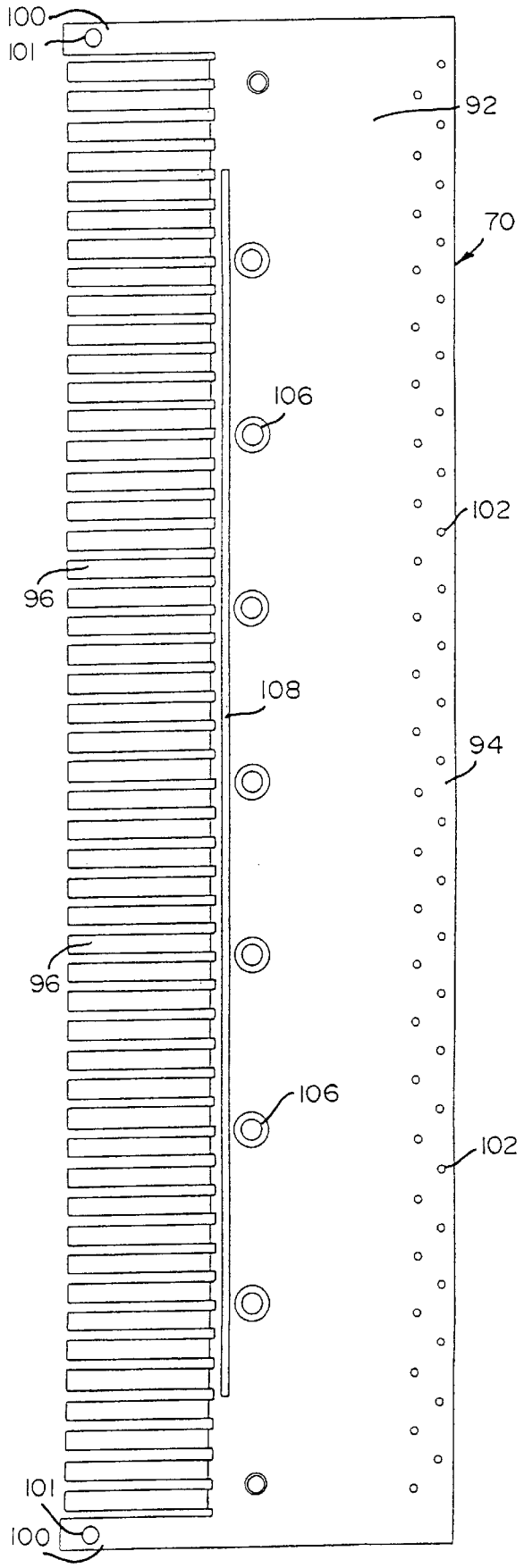
FIG. 7 is a rear elevational view of the contact board used in the female connector.
Figure 8:
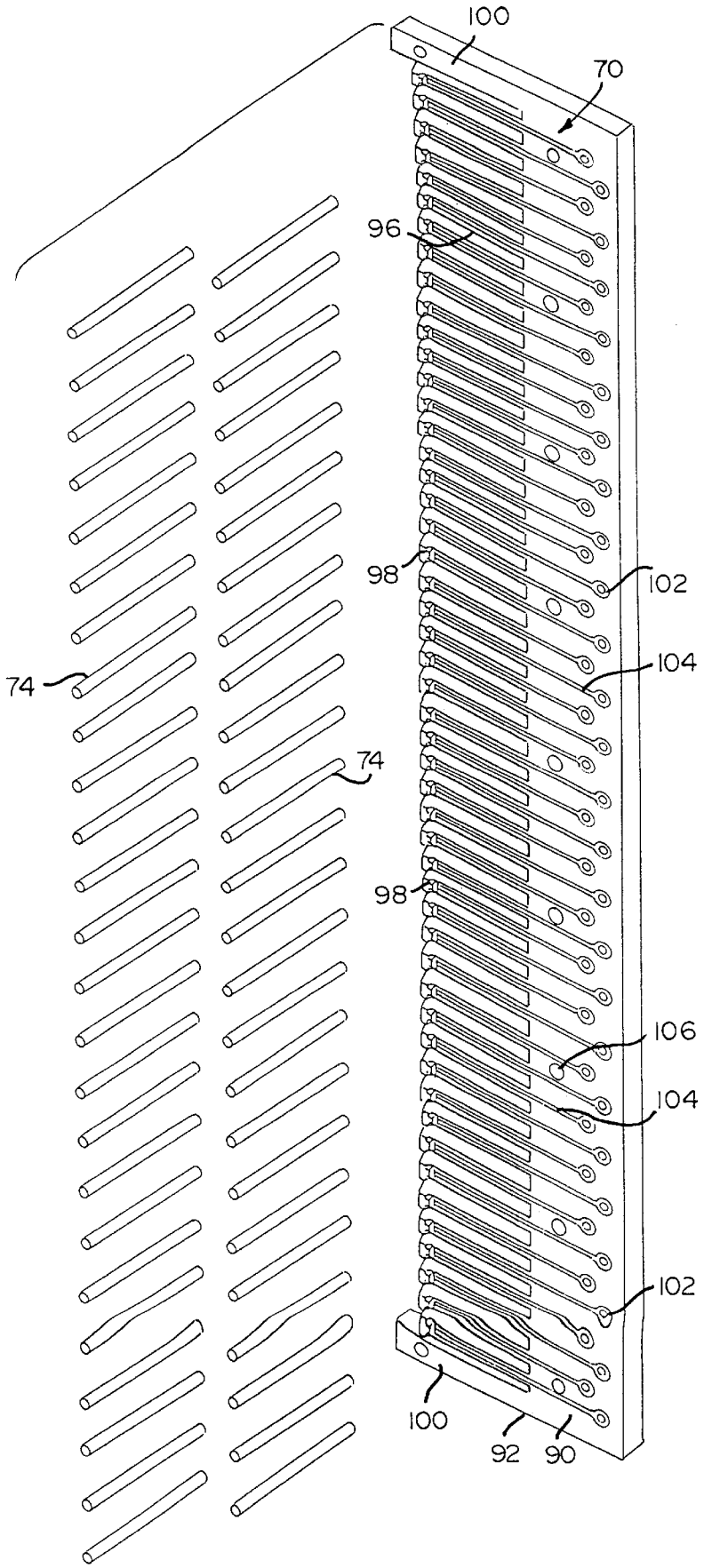
FIG. 8 is an exploded perspective view of the contact board used in the female connector with a plurality of contact pins exploded therefrom.

A plurality of spaced apart apertures 102 are provided through the base portion 94 at the end thereof which opposite to the end from which the fingers 96 extend. The apertures 102 are formed in first and second rows. As shown in FIGS. 6 and 7, the apertures 102 in the first row are aligned with the even numbered fingers 96 (going from left to right in the drawing) while the apertures 102 in the second row are aligned with the odd numbered fingers 96 (going from left to right in the drawing). Thus, going from left to right in FIG. 6, first a second row aperture 102 is encountered, then a first row aperture 102, then a second row aperture 102, then a first row aperture 102 and so on across the base portion 94 of the contact board 70.

A generally straight length of plating 104 is provided on the first side 90 of the contact board 70 and extends from the end of each finger 96, such that the plating 104 covers the projection 98 thereon, along the height of each finger 96 and along the height of the base portion 92 to the aperture 98 aligned beneath the respective finger 96. Each length of plating 104 is preferably formed by first laying down a layer of 0.001 of an inch of copper, then a layer of 0.0001 of an inch of nickel and then a layer of 0.00003 of an inch of gold minimum. The lengths of plating 104 are laid down on the plastic contact board 70 by conventional means.

The contact board 70 also has a plurality of apertures 106 provided therethrough along an upper portion of the base portion 92. The apertures 106 are formed between the lengths of plating 104 at predetermined intervals for connection of the spacer board 78 thereto as described herein.

Finally, contact board 70 includes an elongated groove 108 which extends substantially along the length of the base portion 92 for reasons described herein. The groove 108 is positioned above the apertures 106 and below the base of the fingers 96.

Contact boards 70', 70" are identical in structure to contact board 70, except that the groove 108 is not provided on the second side 92 thereof. Contact board 70'" is identical in structure to contact board 70. Because the elements of the contact boards 70, 70', 70", 70'" are identical except for the differences noted herein, the elements in contact board 70' are labeled in the drawings with identical reference numerals with a single prime after the reference numeral, the elements in contact board 70" are labeled in the drawings with identical reference numerals with a double prime after the reference numeral, and the elements in contact board 70''' are labeled in the drawings with identical reference numerals with a triple prime after the reference numeral. Contact board 70 is shorter in height than contact board 70', which is shorter in height than contact board 70", which is shorter in height than contact board 70'''. Specifically, the contact boards 70, 70', 70", 70''' increase in height such that when the contact boards 70, 70', 70", 70''' are placed together such that the top ends of the fingers 96, 96', 96", 96''' align with each other, the apertures 102, 102', 102", 102''' formed through the base portion 92, 92', 92", 92''' of each are not blocked by the preceding contact board 70, 70', 70", 70'''. This is most clearly shown in FIG. 5.

A contact pins 74 is provided within each aperture 102 in contact board 70; a contact pin 74' is provided within each aperture 102' in contact board 70'; a contact pins 74" is provided within each aperture 102" in contact board 70"; and a contact pin 74''' is provided within each aperture 102''' in contact board 70'''. Each contact pin 74, 74', 74", 74''' is a straight metal pin which is soldered to the respective contact board 70, 70', 70", 70''' such that the contact pins 74 extend outwardly from the second side 92 of contact board 70; contact pins 74' extend outwardly from the first side 90' of contact board 70'; contact pins 74" extend outwardly from the second side 92" of contact board 70"; and contact pins 74'''extend outwardly from the first side 90''' of contact board 70'''. The pins 74, 74', 74", 74''' are preferably fifteen thousandths round and are formed from three quarter hard either gold plated or tin lead plated phosphor bronze. When soldered to the respective contact boards 70, 70', 70", 70''', each pin 74, 74', 74", 74''' forms an electrical connection with the respective lengths of plating 104, 104', 104", 104'''. The contact pins 74, 74', 74", 74''' that are used in the present invention are harder than pins that have been conventionally used because the contact pins 74, 74', 74", 74''' are straight and do not need to be bent as is performed in the prior art.

Figure 9:
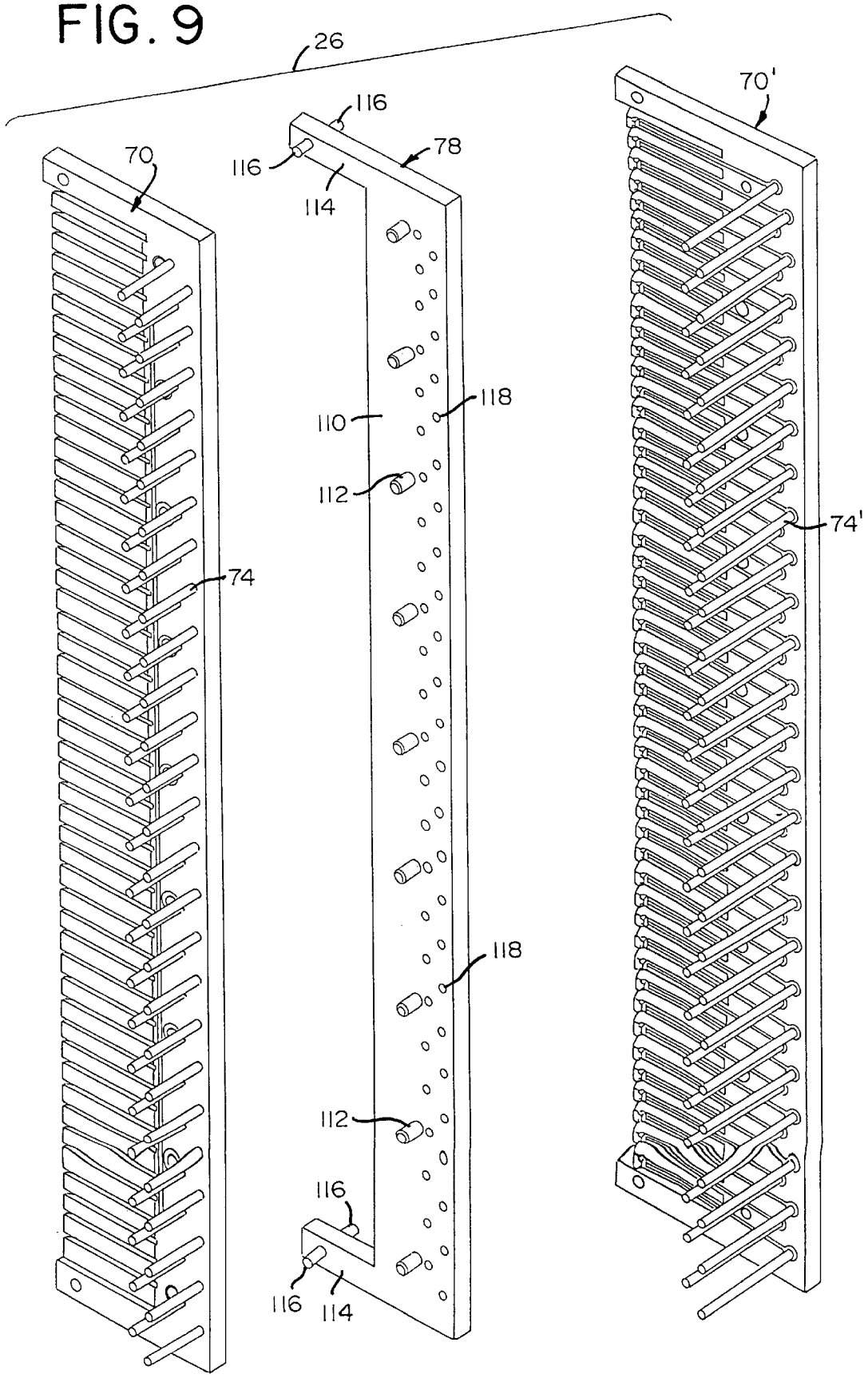
FIG. 9 is an exploded perspective view of a contact board subassembly used in the female connector.
Figure 10:
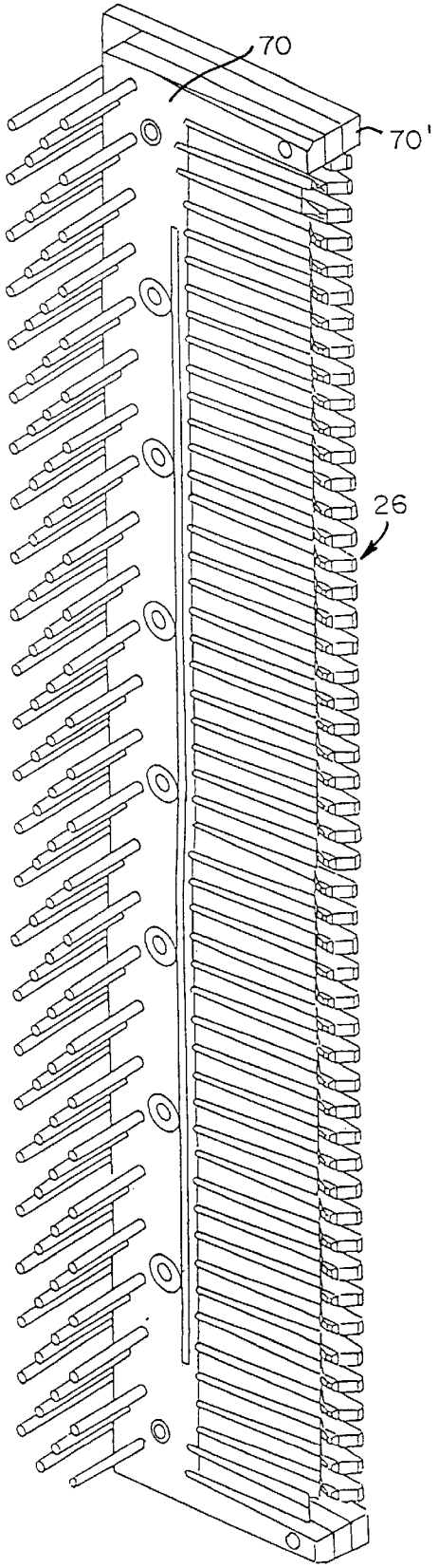
FIG. 10 is an assembled perspective view of the contact board subassembly.
Figure 17:
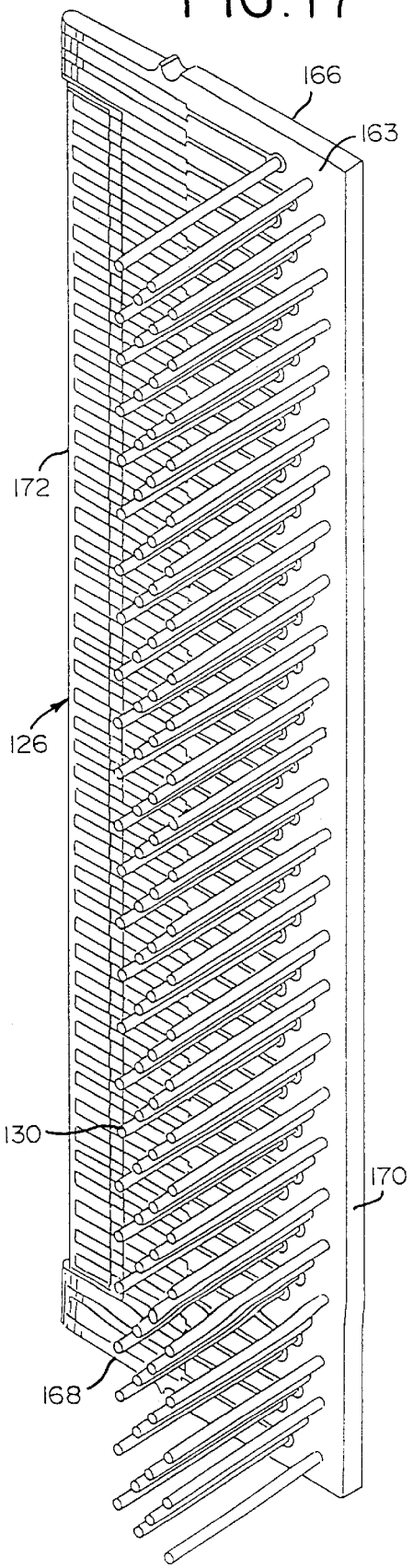
FIG. 17 is an assembled perspective view of the contact board used in the male connector with a plurality of contact pins soldered thereto.

The spacer board 78 which is used to complete assembly of the first contact board subassembly 26 is shown in FIG. 9. It is to be understood that the spacer board 78' which is used to complete assembly of the second contact board subassembly 28 is identical in structure and therefore the identical elements are labeled in the drawings with identical reference numerals with a prime designation. The description of the spacer boards 78, 78' are done with reference to spacer board 78. The spacer board 78 is formed from plastic, preferably liquid crystal polymer, and has a base portion 110 which has a plurality of spaced apart protuberances 112 along the length thereof and which extend outwardly from each side thereof. The protuberances 112 extend outwardly from the base portion 110 in a direction transverse to the length thereof. End portions 114 extend from the opposite ends of the base portion 110 and each has protuberances 116 which extend outwardly from each side thereof. The spacer board 78 has a plurality of apertures 118 extending across the base portion thereof and beneath the protuberances 116. The apertures 118 are formed in two rows in an identical manner to that provided on the contact boards 70, 70'.

To form the first contact board subassembly 26, the spacer board 78 is mounted between the first sides 90, 90' of contact boards 70, 70', each of which has the contact pins 74, 74' soldered thereto as described herein, with the protuberances 112 on the spacer board 78 extending through the respective apertures 106, 106' in the contact boards 70, 70' and the protuberances 116 extending through the respective apertures 101, 101' in the contact boards 70, 70'. The contact boards 70, 70' are thusly positioned such that the plating 104, 104' on each contact board 70, 70' faces the spacer board 78 and the protrusions 98, 98' on the ends of the fingers 96, 96' face each other. The contact pins 74' soldered to contact board 70' extend below the spacer board 78 and below contact board 70. The contact pins 74' are longer in length than contact pins 74 such that the ends of the contact pins 74, 74' are in the same plane. Initially, the protuberances 112, 116 on the spacer board 78 are longer than the thickness of the contact boards 70, 70' such that the protuberances 112, 116 extend outwardly therefrom. The protuberances 112, 116 on the spacer board 78 are then heat staked to the contact boards 70, 70' which causes the protuberances 112, 116 to shorten and become substantially flush with the surface of the contact boards 70, 70'.

To form the second contact board subassembly 28, the spacer board 78' is mounted between the first sides 90", 90''' of contact boards 70", 70''', each of which has the contact pins 74", 74''' soldered thereto as described herein, with the protuberances 112' on the spacer board 78' extending through the respective apertures 106", 106''' in the contact boards 70", 70''' and the protuberances 116' extending through the respective apertures 101", 101''' in the contact boards 70", 70'''. The contact boards 70", 70''' are thusly positioned such that the plating 104", 104''' on each contact board 70", 70''' faces the spacer board 78' and the protrusions 98", 98''' on the ends of the fingers 96", 96''' face each other. The contact pins 74''' soldered to contact board 70''' extend below the spacer board 78' and below contact board 70". The contact pins 74''' are longer in length than contact pins 74" such that the ends of the contact pins 74", 74''' are in the same plane. Initially, the protuberances 112', 116' on the spacer board 78' are longer than the thickness of the contact boards 70", 70''' such that the protuberances 112', 116' extend outwardly therefrom. The protuberances 112', 116' on the spacer board 78' are then heat staked to the contact boards 70", 70''' which causes the protuberances 112', 116' to shorten and become substantially flush with the surface of the contact boards 70", 70'''.

Figure 5:
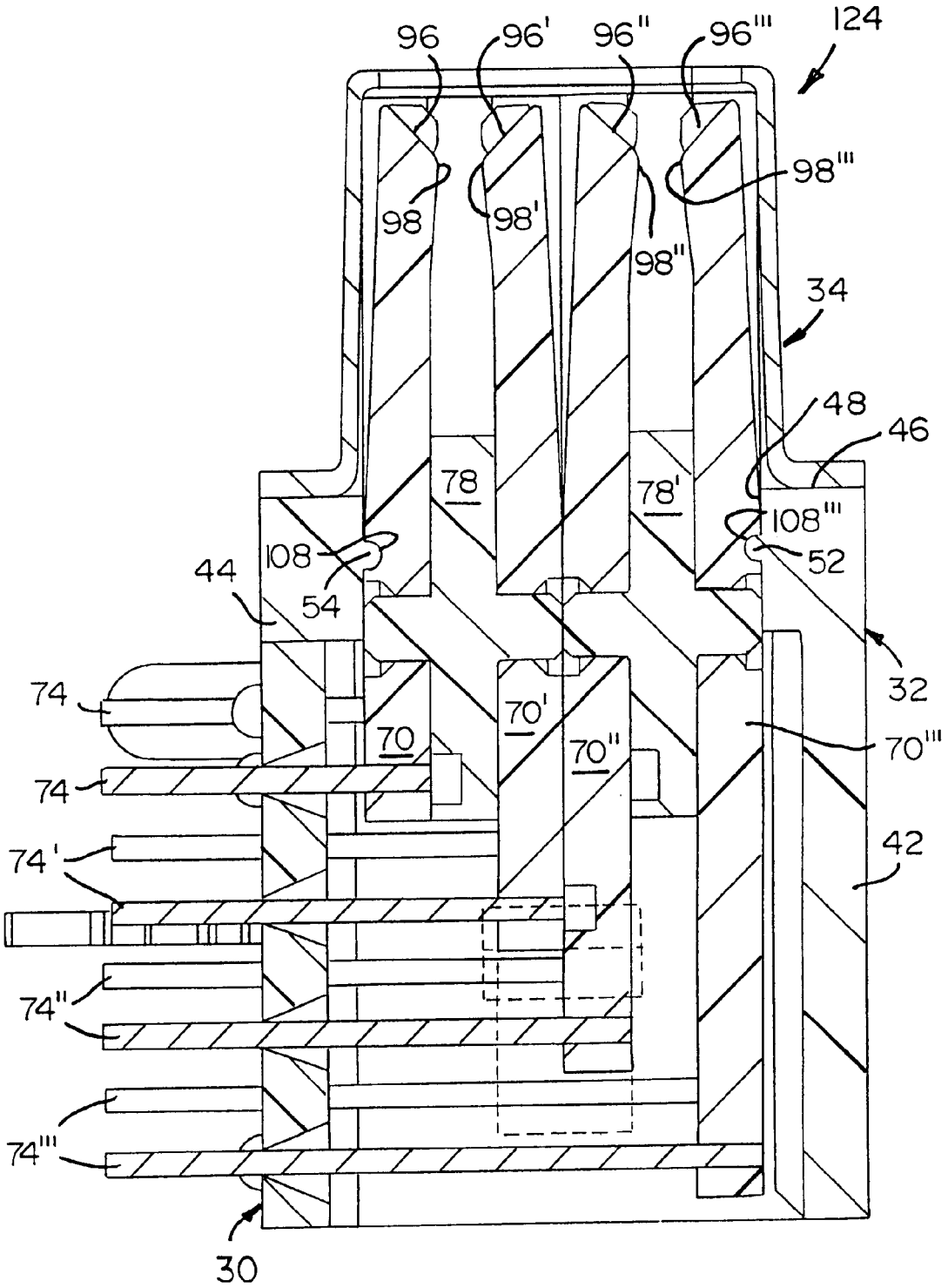
FIG. 5 is a cross-sectional view of the female connector of FIG. 3.

To form a contact board assembly 124 as shown in FIG. 5, the second side 92' of contact board 70' is placed against the second side 92" of contact board 70". As can be seen, contact pins 74", 74''' are longer in length than contact pins 74, 74' such that the ends all of the contact pins 74, 74', 74", 74''' are in the same plane. The contact pins 74", 74''' extend beneath contact boards 70, 70' and spacer board 78. The pin retainer plate 30 is then mounted to the pins 74, 74', 74", 74''' to complete the contact board assembly 124.

The pin retainer plate 30 is formed from plastic, preferably liquid crystal polymer. The pin retainer plate 30 has a pair of projections 120 (only one of which is shown in the drawings) extending outwardly therefrom and eight rows of spaced apart apertures 122 formed therethrough. The top two rows of apertures 122 are formed in an identical manner to that provided on the contact board 70; the next two rows of apertures 122 are formed in an identical manner to that provided on the contact board 70'; the next two rows of apertures 122 are formed in an identical manner to that provided on the contact board 70"; and finally, the bottom two rows of apertures 122 are formed in an identical manner to that provided on the contact board 70'''.

The contact board subassemblies 26, 28 are mounted to the pin retainer plate 30 by extending contact pins 74 of contact board 70 through the top two rows of apertures 122 of the pin retainer plate 30; the contact pins 74' of contact board 70' through the next two rows of apertures 122 of the pin retainer plate 30; the contact pins 74" of contact board 70" through the next two rows of apertures 122 of the pin retainer plate 30; and finally, the contact pins 74''' of contact board 70''' through the bottom two rows of apertures 122 of the pin retainer plate 30. The apertures 122 in the pin retainer plate 30 are tapered so as to permit the easy entry of the contact pins 74, 74', 74'', 74''' therethrough.

To assemble the contact board assembly 124 shown in FIG. 5 with the plastic housing 32, the contact boards 70, 70', 70'', 70''' are inserted into the housing 32 with the contact pins 74, 74', 74'', 74''' extending outwardly therefrom beneath the front wall 44. The contact boards 70, 70', 70'', 70''' are slid into the housing 32 until the protrusions 52, 54 on the housing rear and front walls 42, 44 seat within the elongated grooves 108, 108''' provided in the contact boards 70, 70'''. The fingers 96, 96', 96'', 96''' of the contact boards 70, 70', 70'', 70''' extend upwardly into the shroud 34 mounted on the top wall 46 of the housing 32. This completes the formation of the female connector 22. The edges of one of the contact boards may have a slightly longer length than the remaining contact boards and may slide along grooves provided within the end portions of the housing 32, if desired.

Figure 13A:
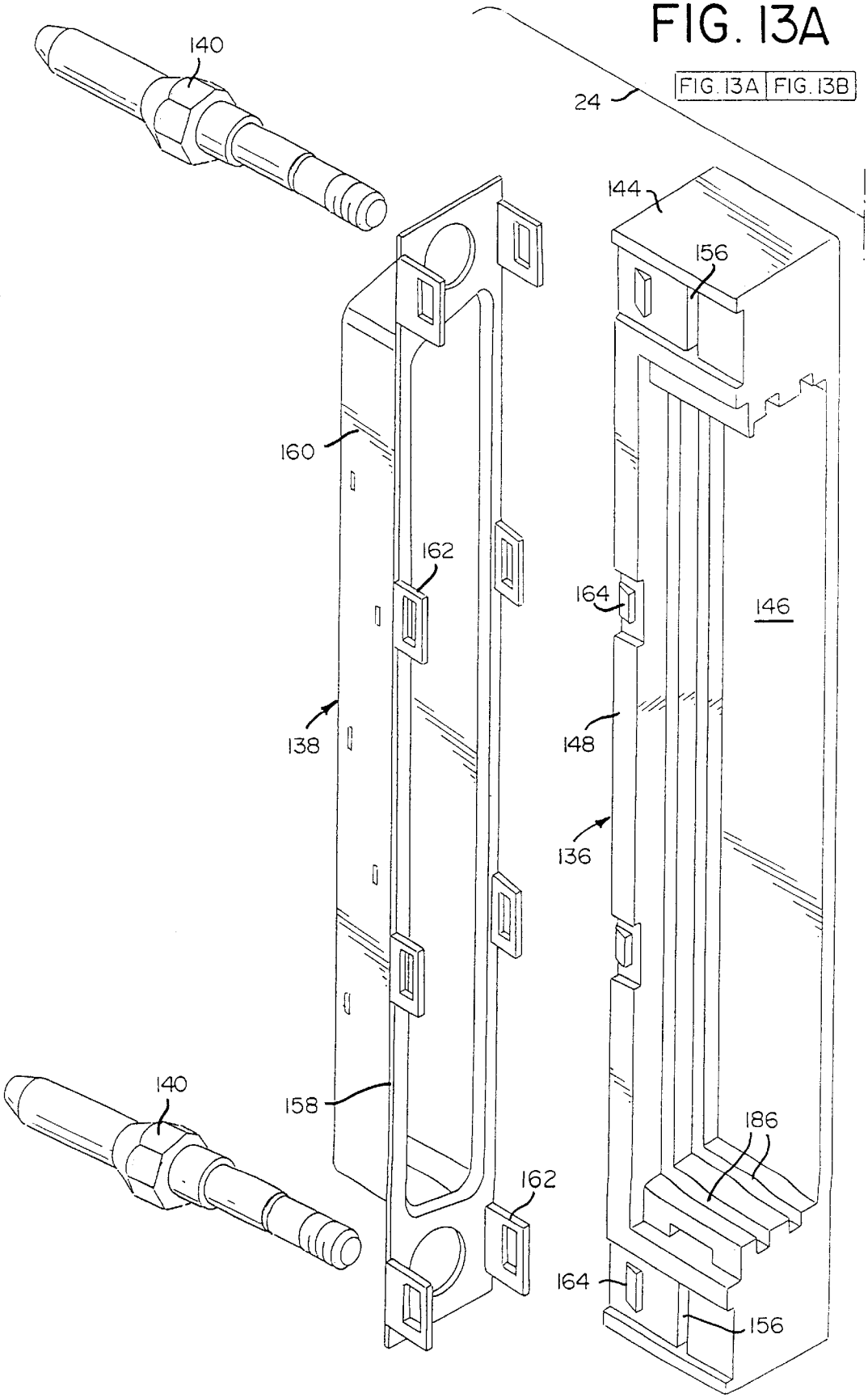
FIG. 13 is an exploded perspective view of the male connector.
Figure 13B:
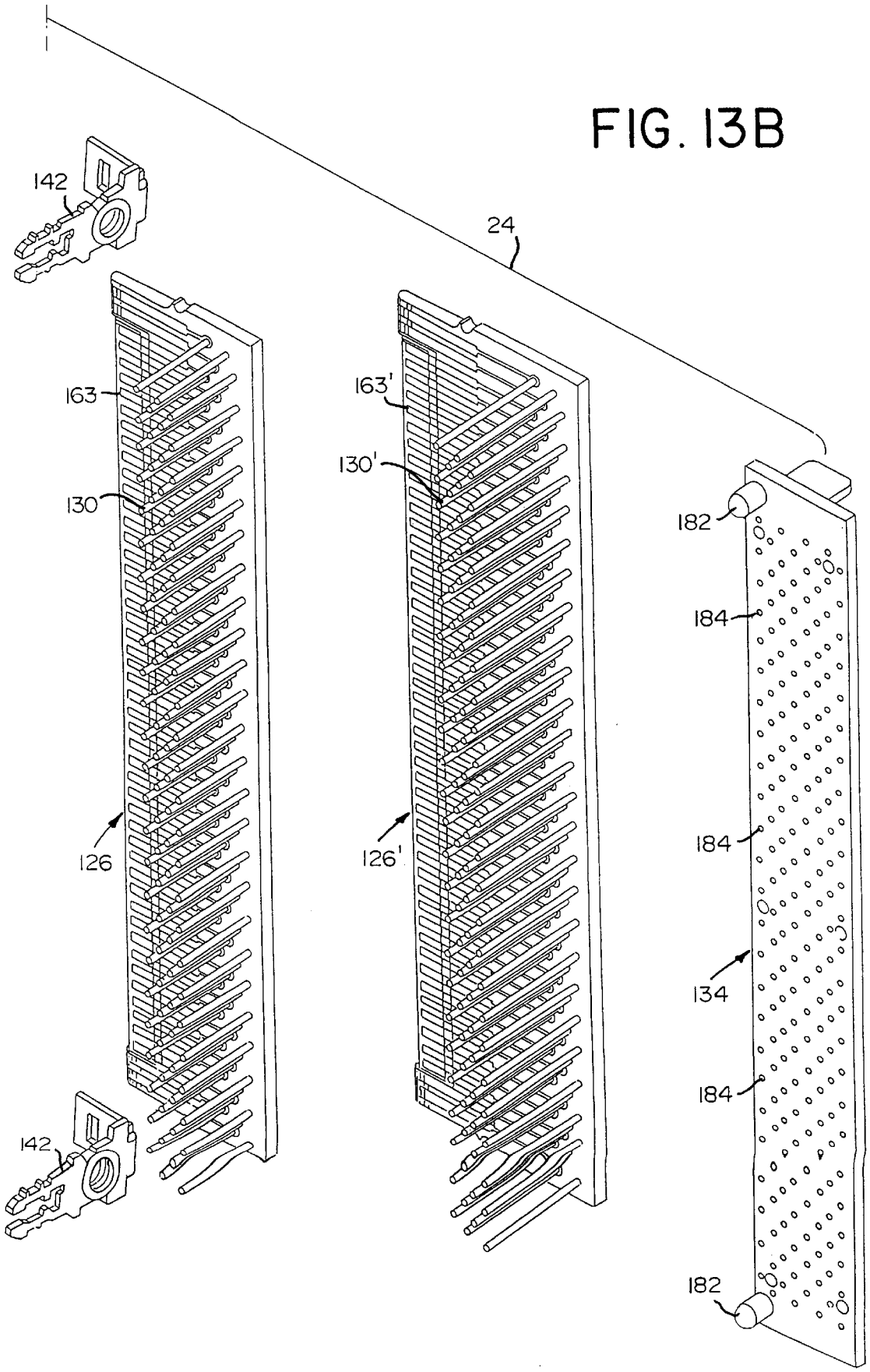

Attention is now directed to FIGS. 12–17 which shows the specifics of the male connector 24. As shown in FIG. 13, the male connector 24 includes first and second contact boards 126, 126', each of which has a plurality of contact pins 130, 130', respectively, mounted thereto, a pin retainer plate 134, a housing 136, a metal shroud 138 which mounts on the housing 136 by a pair of metal guide posts 140 and a pair of metal board locks 142.

The housing 136 is formed from plastic, preferably liquid crystal polymer, and includes a pair of spaced apart end portions 144 which define opposite end walls, a rear wall 146 which extends between edges of the end portions 144 and a bottom wall 150 which has a pair of spaced apart, elongated slots 152, 154 therethrough. The bottom wall 150 extends between edges of the end portions 144 and defines a front wall 148 of the housing 136. The rear wall 146 of the housing 136 extends along the entire height of the end portions 144 while the front wall 148 of the housing 136 only extends along a portion of the height of the end portions 144.

Each end portion 144 of the housing 136 has a recess (not shown) formed therein which extends from the top surface thereof. An elongated slot 156 is also provided through each end portion 144 from its front to its rear, such elongated slots 156 extending transversely to the axis of the respective recesses.

The metal board locks 142 are preferably formed from soldered plated brass and are mounted within the respective elongated slots 156 for grounding to the base board (not shown in the drawings), thus reducing penetration of outside signal noise. The board locks 142 are conventional in design and function.

The metal shroud 138 is preferably nickel plated steel and is formed from a flat base portion 158 and a generally D-shaped mating portion 160 which extends upwardly from the base portion 158. A plurality of apertured tabs 162 extend from the opposite side of the base portion 158 for mating with corresponding protrusions 164 on the rear and front walls 146, 148 of the housing 136 to mount the shroud 138 on the housing 136. A pair of circular apertures (not shown) are provided through end portions of the base portion 158 and align with the recesses in the end portions 144 when the shroud 138 is mounted on the housing 136.

The metal guide posts 140 are conventional and extend through the circular apertures in the base portion 158 and into the recesses in the housing 136. A threaded portion of each guide post 140 threadedly mates with a threaded aperture provided through the respective board locks 142 to secure the shroud 138 to the housing 136.

The contact boards 126, 126' are plastic and are preferably formed from polyetherimide, sold under the trademark ULTEM® (a registered trademark of General Electric). Contact board 126' is identical in structure to contact board 126, except that the contact board 126' is longer in height. The specifics of the contact boards 126, 126' is described with reference to contact board 126 shown in FIGS. 15 and 16. Contact board 126 is formed from a flat plate having first and second sides 163, 165 opposite side edges 166, 168 and opposite top and bottom edges 170, 172. Grooves 174 are formed in the side edges 166, 168 for reasons described herein. The top edge 170 of the contact board 126 is straight. The bottom edge 172 of the contact board 126 has a middle portion which is straight and end portions which extend therefrom.

A plurality of spaced apart apertures 176 are provided proximate to the top edge 170 of the contact board 126. The apertures 176 are formed in first, second, third and fourth rows. The apertures 176 in the first and third rows are aligned with each other and are offset with the apertures 176 in the second and fourth rows, and the apertures 176 in the second and fourth rows are aligned with each other and are offset with the apertures 176 in the first and second rows. Thus, going from left to right in FIG. 15, apertures 176 in the first and third rows are first encountered, then apertures 176 in the second and fourth rows are encountered, then apertures 176 in the first and third rows are encountered, then apertures 176 in the second fourth rows are encountered, and so on across the contact board 170.

Figure 15:
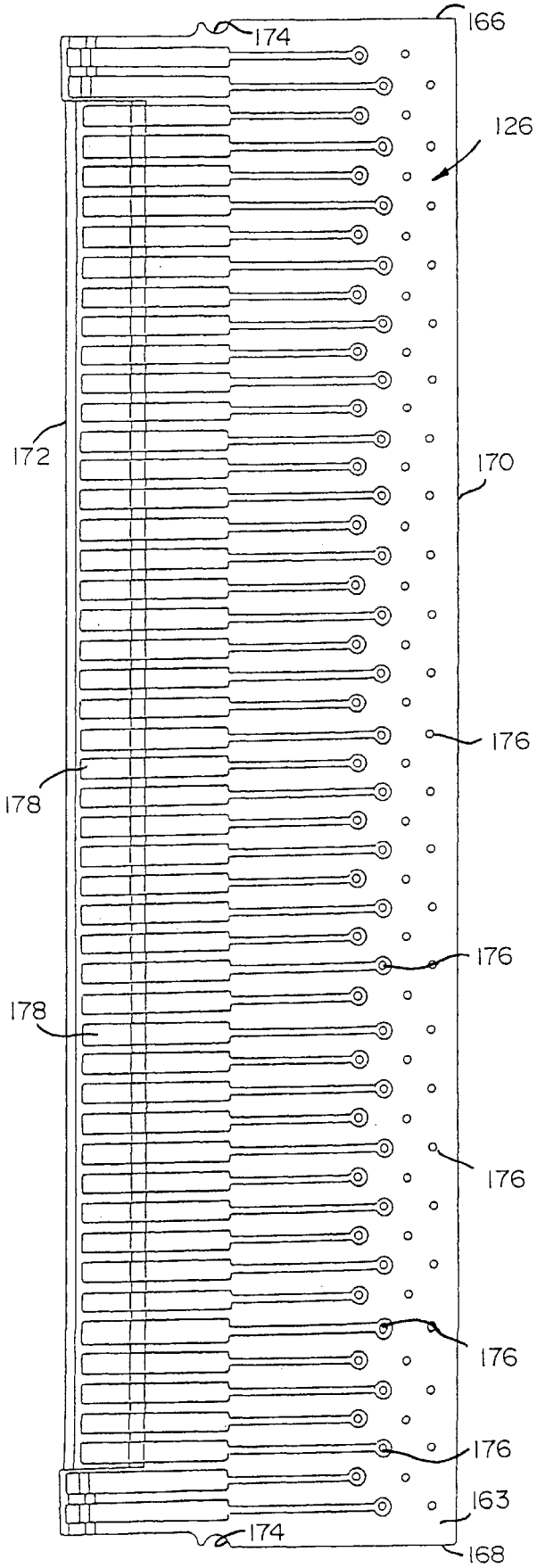
FIG. 15 is a front elevational view of a contact board used in the male connector.
Figure 16:
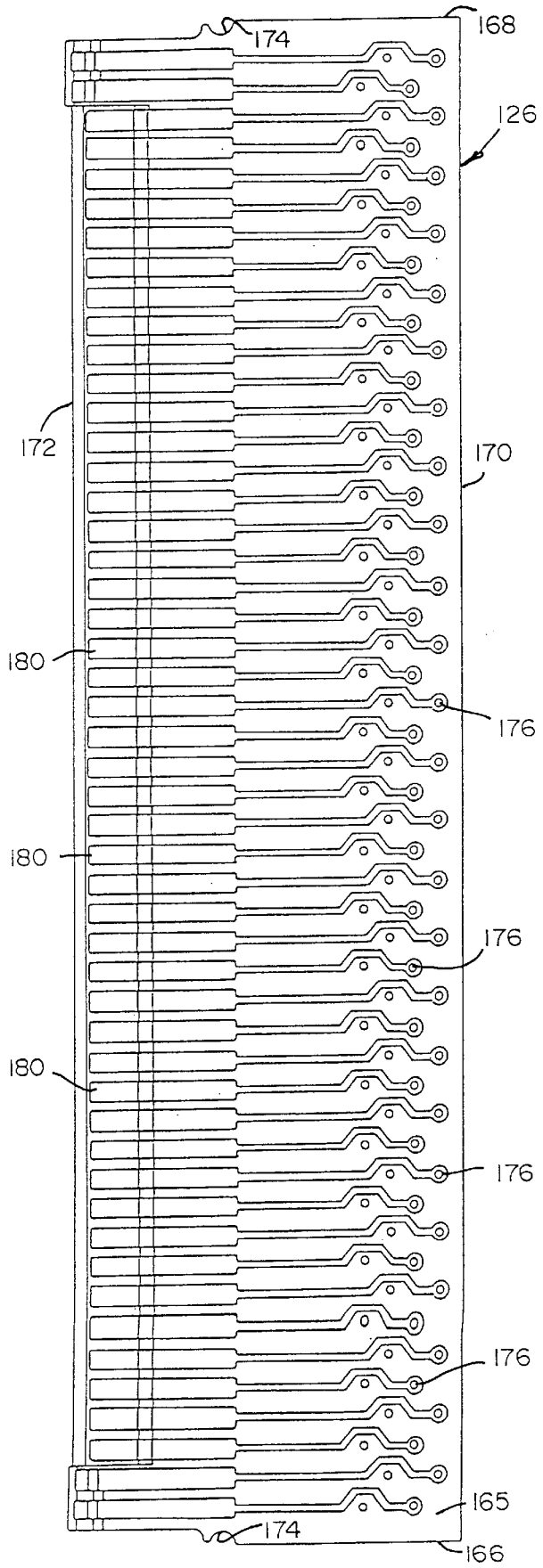
FIG. 16 is a rear elevational view of the contact board used in the male connector.

As shown in FIG. 15, on the first side 163 of the contact board 126, lengths of plating 178 are provided along the length thereof and extend from each aperture 176 in the first and second rows to the bottom edge 172. The lengths of plating 178 are spaced apart from each other. As shown in FIG. 16, on the second side 165 of the contact board 126, lengths of plating 180 are provided along the length thereof and extend from each aperture 176 in the third and fourth rows to the bottom edge 172. The lengths of plating 180 are spaced apart from each other and do not contact the apertures 176 in the first and second rows. Each length of plating 178, 180 is preferably formed by first laying down a layer of 0.001 of an inch of copper, then a layer of 0.0001 of an inch of nickel and then a layer of 0.00003 of an inch of gold minimum. Each length of plating 178, 180 is laid down on the plastic contact board 126 by conventional means.

Each contact pins 130, 130' is a straight metal pin which is placed through the apertures 176, 176' in the respective contact boards 126, 126'. The contact pins 130, 130' are soldered to the respective contact boards 126, 126' such that the contact pins 130, 130' extend outwardly from the respective first sides 163, 163' of the respective contact boards 126, 126'. The contact pins 130, 130' are preferably fifteen thousandths round and are formed from three quarter hard either gold plated or tin lead plated phosphor bronze. When soldered to the respective contact boards 126, 126', each contact pin 130, 130' forms an electrical connection with the respective length of plating 178, 180 on the first or second sides 163, 165 of the contact boards 126, 126'. Like that of the female connector 22, the contact pins 130, 130' that are used in the present invention are harder than pins that have been conventionally used because the contact pins 130, 130' are straight and do not need to be bent as is performed in the prior art.

The contact boards 126, 126', with the contact pins 130, 130' soldered thereto, are mounted to the pin retainer plate 134 to form a contact board assembly. The pin retainer plate 134 is formed from plastic, preferably liquid crystal polymer. The pin retainer plate 134 has a pair of projections 182 extending outwardly therefrom and eight rows of spaced-apart apertures 184 formed therethrough. The top four rows of apertures 184 are formed in an identical manner to that of the contact pins 130 provided on the contact board 126. The bottom fours rows of apertures 184 are formed in an identical manner to that of the contact pins 130' provided on the contact board 126'.

Figure 14:
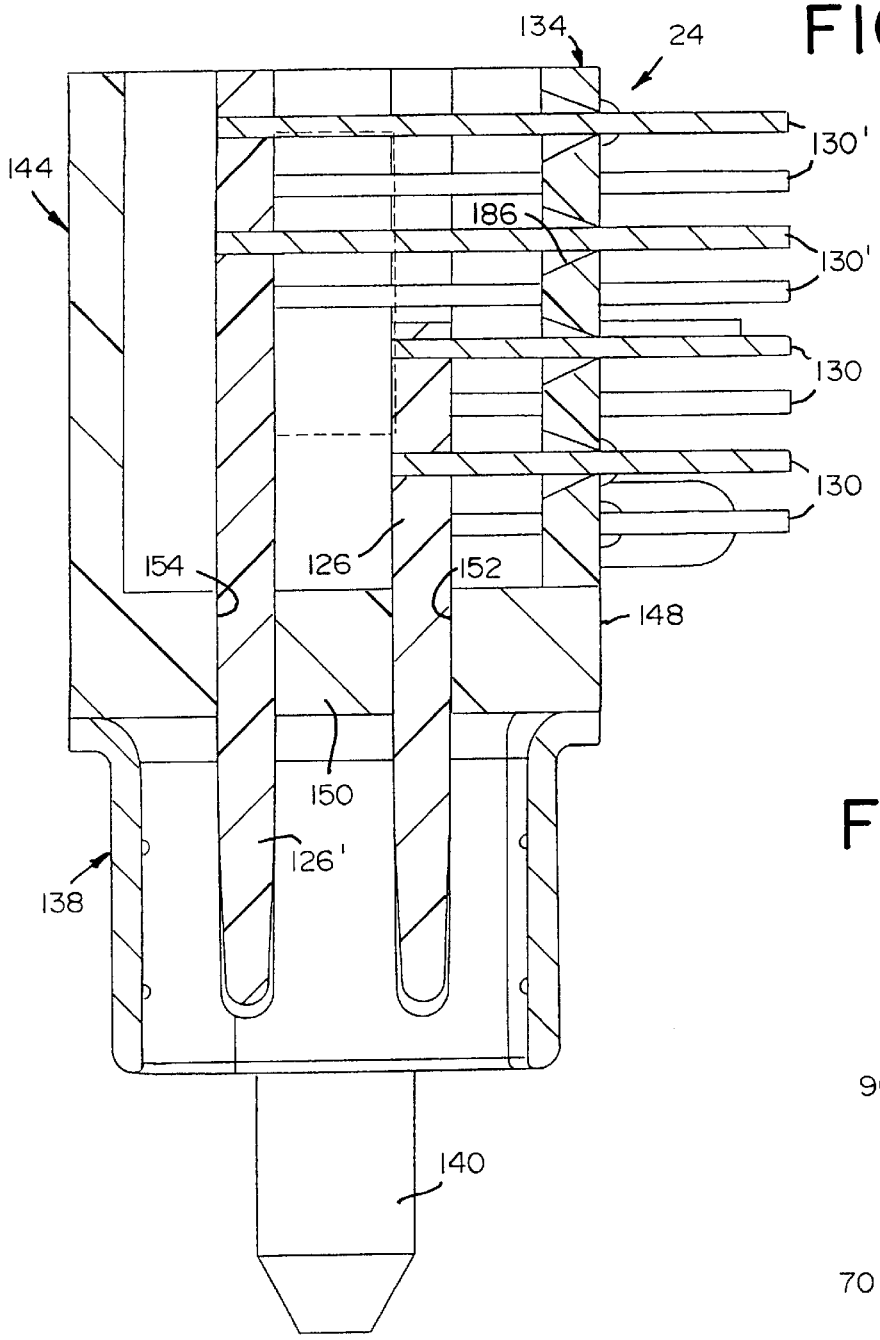
FIG. 14 is a cross-sectional view of the male connector of FIG. 12.
Figure 11:
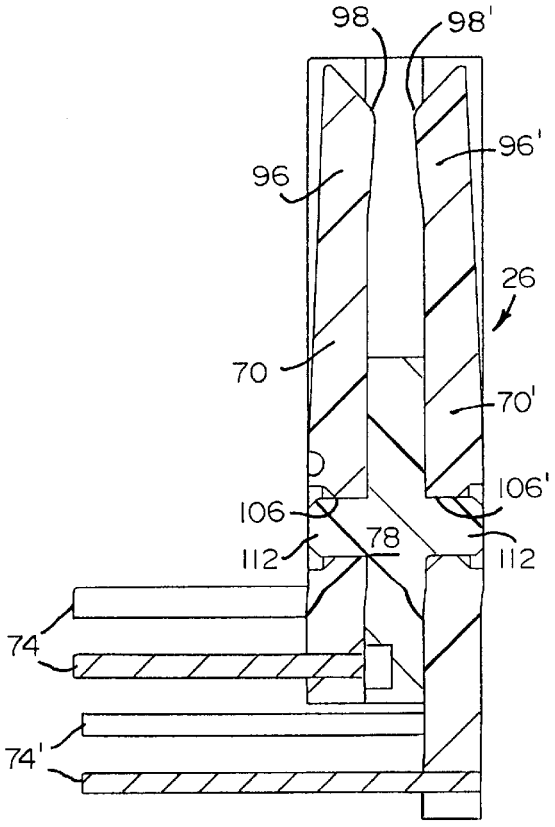
FIG. 11 is a cross-sectional view of the contact board subassembly.

The contact boards 126, 126' are mounted to the pin retainer plate 134 by extending the contact pins 130 of contact board 126 through the top four rows of the pin retainer plate 134 and by extending the contact pins 130' of contact board 126' through the bottom four rows of the pin retainer plate 134. As best shown in FIG. 14, the contact board 126 is shorter than the contact board 126' so that the contact pins 130' soldered to contact board 126' can extend freely without interference from the contact board 126. In addition, the contact pins 130' are longer in length than contact pins 130 such that when the contact boards 126, 126' are mounted to the pin retainer plate 134 and to the housing 136 as described herein, the ends of the contact pins 130, 130' are flush with each other. The apertures 184 in the pin retainer plate 134 are tapered so as to permit the easy entry of the contact pins 130, 130' therethrough.

To assemble the contact boards 126, 126' with the housing 136, the contact boards 126, 126' are inserted through the respective slots 152, 154 in the housing 136 with the contact pins 130, 130' extending outwardly therefrom beneath the front wall 148. The interior edges of the end portions 144 have grooves 186 therealong in which the edges of the contact boards 126, 126' slide. The contact boards 126, 126' are slid into the housing 136 until the grooves 174, 174' in the side edges 166, 168; 166', 168' of the contact boards 126, 126' engage with protrusions (not shown) provided along the grooves 186. The lower ends of the contact boards 126, 126' extend upwardly into the metal shroud 138 mounted on the bottom wall 150 of the housing 136. This completes the formation of the male connector 24.

To connect the female and male connectors 22, 24 to form the completed connector 20, the D-shaped portion 60 of the female connector shroud 34 is inserted within the D-shaped portion 138 of the male connector shroud 138 which causes the lower end of the contact board 126 in the male connector 24 to engage between fingers 96, 96' of the female connector 22; and the lower end of the contact board 126' in the male connector 24 to engage between fingers 96", 96'" of the female connector 22. The D-shaped portion 50 of the female connector shroud 34 is only slightly smaller than the D-shaped portion 160 of the male connector shroud 138 such that a tight friction fit is obtained. The lengths of plating on the respective sides of the male contact boards electrically connect with the lengths of plating on the respective contact boards of the female connector. The guide posts 140 on the male connector 24 engage within the guide posts 36 on the female connector 22. The contact pins on the female and male connectors 22, 24 extend outwardly therefrom in the same direction. This completes the connector 20.

While the female connector 22 is shown with four contact boards 70, 70', 70", 70'", it is to be understood that the female connector 22 may only have one contact board or more than two contact boards. Also, each contact board provided in the female connector 22 may have one or more contact pins with the same number of corresponding lengths of plating.

While the male connector 24 is shown with two contact boards 126, 126', it is to be understood that the male connector 24 may only have one contact board or more than two contact boards. Also, each contact board provided in the male connector 24 may have one or more contact pins with the same number of corresponding lengths of plating.

Preferably, the female connector 22 has two contact boards for each contact board provided in the male connector 24 so that the contact board of the male connector 24 can be inserted therebetween and, preferably, the male connector 24 has at least one length of plating on each side of the contact board provided therein.

While a preferred embodiment of the present invention is shown and described, it is envisioned that those skilled in the art may devise various modifications of the present invention without departing from the spirit and scope of the appended claims.

The invention claimed is:

1. A male or female connector comprising:

a housing;

first and second contact boards mounted in said housing, said first contact board being shorter in length than said second contact board;

at least one length of electrically conductive plating provided on each said contact board; and at least one electrically conductive contact pin attached to each said contact board, said at least one contact pin being in electrical connection with said at least one length of plating on each said contact board, said at least one contact pin which is attached to said second contact board does not contact said first contact board; and a pin retainer plate attached to said housing, said at least one contact pin on each said contact board extending through a corresponding aperture provided through said pin retainer plate.

2. A male or female connector as defined in claim 1, wherein said at least one contact pin on each said contact board is straight.

3. A male or female connector as defined in claim 1, wherein said at least one contact pin on each said contact board is mounted through a corresponding aperture through each said contact board.

4. A male or female connector as defined in claim 1, wherein said at least one length of plating is formed by a first layer of 0.001 of an inch of copper, a second layer of 0.0001 of an inch of nickel, and a third layer of 0.00003 of an inch of gold minimum.

5. A male or female connector as defined in claim 1, wherein said at least one contact pin on each said contact board is formed from gold plated or tin lead plated phosphor bronze.

6. A male or female connector as defined in claim 1, wherein said at least one contact pin on each said contact board is fifteen thousandths round.

7. A male or female connector as defined in claim 1, wherein said at least one contact board on each said contact board is plastic.

8. A male or female connector as defined in claim 1, wherein said aperture through said pin retainer plate is tapered.

9. A male or female connector as defined in claim 1, wherein each said contact pin is straight.

10. A male or female connector as defined in claim 1, further comprising a metal shroud attached to said housing.

11. A female connector comprising:

a housing;

at least one pair of contact boards mounted in said housing, said at least one pair of contact boards being defined by a first contact board and a second contact board;

at least one length of electrically conductive plating provided on said first contact board;

at least one electrically conductive contact pin attached to said first contact board and being in electrical connection with said at least one length of plating on said first contact board;

at least one length of electrically conductive plating provided on said second contact board;

at least one electrically conductive contact pin attached to said second contact board and being in electrical connection with said at least one length of plating on said second contact board, wherein said lengths of plating on said first and second contact boards face each other.

12. A female connector as defined in claim 11, wherein said first contact board is shorter in length than said second contact board, and said at least one contact pin attached to said second contact board does not contact said first contact board.

13. A female connector as defined in claim 11, further comprising a pin retainer plate attached to said housing and said contact pins attached to said first and second contact boards extend through corresponding apertures provided through said pin retainer plate.

14. A female connector as defined in claim 13, wherein said apertures through said pin retainer plate are tapered.

15. A female connector as defined in claim 11, wherein each said contact pin is straight.

16. A female connector as defined in claim 11, wherein each said contact pin is mounted through an aperture through said respective contact board.

17. A female connector as defined in claim 11, wherein each said length of plating is formed by a first layer of 0.001 of an inch of copper, a second layer of 0.0001 of an inch of nickel, and a third layer of 0.00003 of an inch of gold minimum.

18. A female connector as defined in claim 11, wherein each said contact pin is formed from gold plated or tin lead plated phosphor bronze.

19. A female connector as defined in claim 11, wherein each said contact pin is fifteen thousandths round.

20. A female connector as defined in claim 11, further comprising a spacer member between said first and second contact boards.

21. A female connector as defined in claim 11, wherein each said contact board is plastic.

22. A female connector as defined in claim 11, wherein each said contact board is formed from a base having a predetermined height and having at least one finger having a predetermined height attached thereto, said length of plating extending along the height of the finger and along the height of the base.

23. A female connector as defined in claim 22, wherein said at least one finger has a projection thereon, said length of plating extending over said projection.

24. A male connector comprising:

a housing;

first and second contact boards mounted in said housing, said at least one contact board having first and second sides, said first contact board being shorter in length than said second contact board;

at least one length of electrically conductive plating provided on each of said first and second sides of each said contact board;

at least a pair of electrically conductive contact pins attached to each said contact board, each said contact pin attached to each said contact board being in electrical connection with a corresponding one of said at least one length of plating, and said contact pins attached to said second contact board do not contact said first contact board.

25. A male connector as defined in claim 24, further comprising a pin retainer plate attached to said housing and said contact pins attached to each said contact board extend through corresponding apertures provided through said pin retainer plate.

26. A male connector as defined in claim 25, wherein said apertures through said pin retainer plate are tapered.

27. A male connector as defined in claim 24, wherein each said contact pin is straight.

28. A male connector as defined in claim 24, wherein each said contact pin is mounted through a corresponding aperture through each said contact board.

29. A male connector as defined in claim 24, wherein each said length of plating is formed by a first layer of 0.001 of an inch of copper, a second layer of 0.0001 of an inch of nickel, and a third layer of 0.00003 of an inch of gold minimum.

30. A male connector as defined in claim 24, wherein each said contact pin is formed from gold plated or tin lead plated phosphor bronze.

31. A male connector as defined in claim 24, wherein each said contact pin is fifteen thousandths round.

32. A male connector as defined in claim 24, wherein each said contact board is plastic.

33. A connector comprising:

a male connector comprising a housing, first and second contact boards mounted in said housing, said first contact board being shorter in length than said second contact board, at least one length of electrically conductive plating provided on each said contact board, and at least one electrically conductive contact pin attached to each said contact board, said at least one contact pin being in electrical connection with said at least one length of plating on each said contact board, each said at least one contact pin which is attached to each said second contact board does not contact said respective first contact board, a pin retainer plate attached to said housing, said at least one contact pin extending through a corresponding aperture provided through said pin retainer plate; and a female connector comprising a housing, first and second contact boards mounted in said housing, said first contact board being shorter in length than said second contact board, at least one length of electrically conductive plating provided on each said contact board, and at least one electrically conductive contact pin attached to each said contact board, said at least one contact pin being in electrical connection with said at least one length of plating on said at least one contact board, each said at least one contact pin which is attached to each said second contact board does not contact said respective first contact board, a pin retainer plate attached to said housing, said at least one contact pin extending through a corresponding aperture provided through said pin retainer plate, wherein said male and female connectors are capable of being connected together.

34. A connector as defined in claim 33, wherein each said at least one contact pin is straight.

35. A connector as defined in claim 33, wherein each said at least one contact pin is mounted through a corresponding aperture through each said contact board.

36. A connector as defined in claim 33, wherein each said at least one length of plating is formed by a first layer of 0.001 of an inch of copper, a second layer of 0.0001 of an inch of nickel, and a third layer of 0.00003 of an inch of gold minimum.

37. A connector as defined in claim 33, wherein each said at least one contact pin is formed from gold plated or tin lead plated phosphor bronze.

38. A connector as defined in claim 33, wherein each said at least one contact pin is fifteen thousandths round.

39. A connector as defined in claim 33, wherein each said contact board is plastic.

40. A connector as defined in claim 33, wherein each said aperture through each said pin retainer plate is tapered.

41. A connector as defined in claim 33, wherein each said contact pin is straight.

42. A connector as defined in claim 33, wherein said first contact board in said male connector is positioned between said first and second contact boards in said female connector.

43. A connector as defined in claim 42, wherein each said contact board in said female connector is formed from a base having a predetermined height and having at least one finger having a predetermined height attached thereto, said length of plating extending along the height of the finger and along the height of the base.

44. A connector as defined in claim 43, wherein said at least one finger has a projection thereon, said length of plating extending over said projection.

45. A connector as defined in claim 33, wherein said male connector further includes a metal shroud attached to said male connector housing and said female connector further includes a metal shroud attached to said female connector housing, said male and female connectors being attached together by said metal shrouds.

* * * * *